United States Patent [19]

Lay

[11] 4,441,710

[45] Apr. 10, 1984

[54] BOWLING RAMP ATTACHMENT FOR WHEELCHAIRS

[76] Inventor: Larry D. Lay, 26078 Alger, Madison Heights, Mich. 48071

[21] Appl. No.: 380,519

[22] Filed: May 21, 1982

Related U.S. Application Data

[63] Continuation-in-part of Ser. No. 178,952, Aug. 18, 1980, Pat. No. 4,368,898.

[51] Int. Cl.[3] ..... A63D 5/00

[52] U.S. Cl. ..... 273/54 R

[58] Field of Search ..... 280/289 WC; 273/54 R, 273/120 R, 129 R; 297/217, DIG. 4

[56] References Cited

U.S. PATENT DOCUMENTS

| | | | |
|---|---|---|---|
| 3,083,967 | 4/1963 | Steel | 273/54 R |
| 3,159,401 | 12/1964 | Ikenberry | 273/54 R |
| 3,215,436 | 11/1965 | Carter | 273/54 R |
| 3,481,601 | 12/1969 | Santora | 273/54 R |
| 3,539,183 | 11/1970 | Lieb | 273/54 R |
| 3,578,322 | 5/1971 | Kerr | 273/54 R |

*Primary Examiner*—John A. Pekar

*Attorney, Agent, or Firm*—Basile, Weintraub & Hanlon

[57] ABSTRACT

A bowling ramp attachment for wheelchairs. The ramp attachment includes a ramp in the form of a pair of spaced rod members which extend in an inclined manner from the seat area of the wheelchair to the floor. The ramp is slidingly attached to the wheelchair so as to be selectively movable across the front of the wheelchair. A pair of vertically extending posts are releasably clamped to the front frame members of the wheelchair. A cross bar is slidingly carried by the posts so as to be movable laterally across the front of the wheelchair. The cross bar is slidingly attached to the ramp to enable the ramp and the cross bar to be selectively positioned across the front of the wheelchair for directing a bowling ball in a variety of paths toward the bowling pins. In another embodiment, the bowling ramp is configured for free standing use with a wheelchair and includes a pair of support posts which are supported in an upright manner on the floor. The cross bar is carried by the support posts and is adjustable between a plurality of vertical positions. The ramp is, in turn, slidingly attached to the cross bar.

13 Claims, 5 Drawing Figures

10
12
18
20
26
28
44
60
62
64
66
68
70
72
74
76
80
82
84
86
88
90
92
94
96
98
3
4

BOWLING RAMP ATTACHMENT FOR WHEELCHAIRS

CROSS-REFERENCE TO CO-PENDING APPLICATION

This application is a continuation-in-part application of co-pending application, U.S. Pat. Ser. No. 178,952, filed Aug. 18, 1980, in the name of Larry D. Lay and entitled "BOWLING RAMP ATTACHMENT FOR WHEELCHAIRS", now U.S. Pat. No. 4,368,898.

BACKGROUND OF THE INVENTION

1. Field Of The Invention

This invention relates, in general, to wheelchairs and, more specifically to attachments for or devices for use with wheelchairs for specialized purposes.

2. Description Of The Prior Art

A large number of devices have been provided for attachment to or use with wheelchairs that enable a specialized use of the the wheelchair by the occupant. Such devices include lifting apparatus and ramps which enable the occupant of the wheelchair to move between the wheelchair and a vehicle or other support. Also, assorted exercise devices, such as the bicycle-like leg exercise device shown in U.S. Pat. No. 3,423,086, are known for use with wheelchairs.

Such devices, however, do not facilitate the use of the wheelchair in sporting events. If the occupant of the wheelchair wishes to participate in certain sports, such as basketball or bowling, he or she must physically move the wheelchair about while using his or her arms to perform the necessary activity required by the sport. This is often beyond the strength and capability of the handicapped and, in particular, children and therefore prevents these people from participating in many types of sporting events.

This is particularly true with the game of bowling. In order to bowl, the occupant who is usually seated in his wheelchair at the foul line of the bowling lane, must reach over the side of the wheelchair to release the ball towards the pins. Due to the weight of the ball and the difficulty in holding ahd swinging it over the side of the wheelchair, the handicapped have not previously been able to bowl or to bowl effectively. Stand alone ramps have been used by the handicapped in bowling. The ramps are positioned on the bowling lane and enable the ball to be urged down the ramp towards the pins. However, such ramps are bulky and cannot be easily positioned for rolling the ball in a variety of paths towards only certain pins. This has detracted from the enjoyment of the game of bowling by occupants of wheelchairs.

Thus, it would be desirable to provide a ramp attachment for a wheelchair which overcomes the problems of prior art attachments in permitting the occupant to effectively participate in the game of bowling. It would also be desirable to provide a ramp for a wheelchair which can be easily positioned with respect to the wheelchair in order to direct the ball in a variety of paths down the bowling lane towards the pins. It would also be desirable to provide a ramp attachment for a wheelchair which is simply constructed of lightweight components and which is easily and quickly disassembled for storage or transportation. Finally, it would be desirable to provide a ramp which is free standing, but which is adjustable in both horizontal and vertical directions for use with different size wheelchairs and partially ambulatory persons.

SUMMARY OF THE INVENTION

There is disclosed herein a unique ramp attachment for a wheelchair. The ramp attachment includes means for guiding a bowling ball from the seat area of the wheelchair towards the bowling pins. The ramp is in the form of a pair of spaced rod members which extend from the seat of the wheelchair to the floor in an inclined manner. Means are provided for slidingly securing the guiding means to the wheelchair such that the guiding means is movable laterally across the front of the wheelchair. The securing means includes a cross bar which extends laterally across the front of the wheelchair, a first means for attaching the cross bar to the wheelchair and a second means for attaching the guiding means to the cross bar. The first attaching means includes a pair of vertically extending support posts which slidingly carry the cross bar at the top end thereof. Clamping means are provided for releasably attaching the support posts to the frame of the wheelchair such that the height of the support posts with respect to the seat of the wheelchair can be varied as desired. A strap carried by the guiding means slidingly receives the cross bar such that the guiding means is movable with respect to the cross bar.

The bowling ramp attachment of the present invention is constructed of relatively few, lightweight components which enables it to be quickly and easily assembled for use with any conventional wheelchair or ambulatory assistance device. Furthermore, the various components are separable which enables the ramp attachment to be quickly disassembled for storage or transport.

The ramp attachment of the present invention is uniquely constructed such that the ramp may be positioned anywhere across the front of the wheelchair and at any height so as to enable the ball to be rolled down the ramp towards the pins in a variety of different paths so as to strike only certain of the pins if desired. This increases the enjoyment of the game of bowling for the occupant of the wheelchair since the occupant can more effectively participate in the game.

BRIEF DESCRIPTION OF THE DRAWING

The various features, advantages and other uses of the present invention will become more apparent by referring to the following detailed description and drawing in which:

FIG. 1 is a perspective view of a wheelchair having a ramp attachment attached thereto which is constructed in accordance with the teachings of this invention;

DESCRIPTION OF THE PREFERRED EMBODIMENTS

Figure 2:
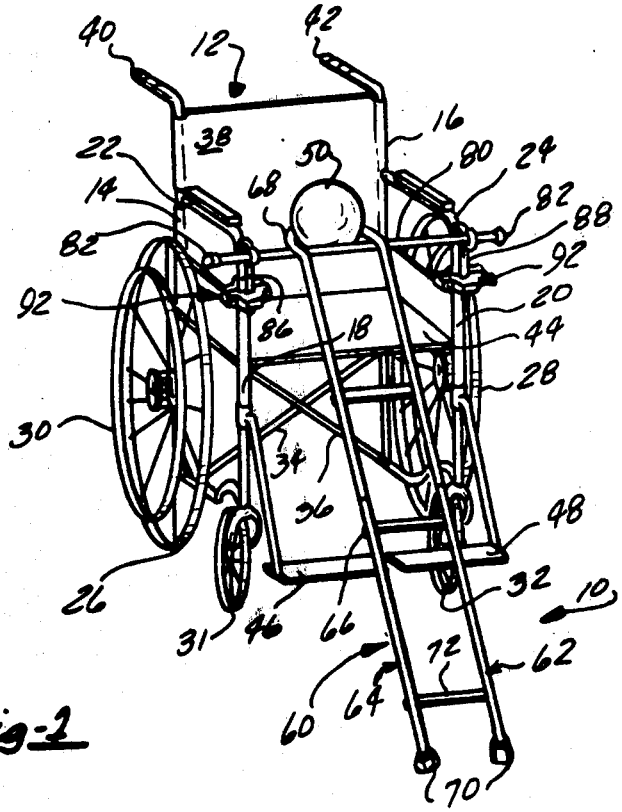
FIG. 2 is a plan view of the ramp attachment shown in FIG. 1.

Throughout the following description and drawing, identical reference numbers are used to refer to the same component shown in multiple figures of the drawing.

Referring now to the drawing, and to FIG. 1 in particular, there is shown a ramp attachment 10 for use with a wheelchair 12 which enables the occupant of the wheelchair to participate in sporting events, such as bowling.

Since the ramp attachment 12 can be attached to any conventional wheelchair, one example of a wheelchair 12 will be described in order to clarify the understanding of the present invention. The wheelchair 12 includes a chassis having a pair of rear vertical frame members 14 and 16 and a pair of front vertical frame members 18 and 20. Connecting members 22 and 24, which serve as arm rests, connect the front and rear frame members to form a unitary chassis. Shafts extend outward from the lower portion of the rear frame members 14 and 16 and serve as supports for large diameter rear wheels 26 and 28. Hand rims, such as hand rim 30, are also concentrically disposed on the shafts so as to enable the occupant of the wheelchair 12 to move the wheelchair. Smaller front wheels 31 and 32 are pivotally connected to the bottom end of the front vertical frame members 18 and 20, respectively. Cross connecting members 34 and 36 interconnect the front and rear frame members and enable the wheelchair 12 to be collapsed for storage or transport.

The rear frame members 14 and 16 support a back panel 38 therebetween and have handles 40 and 42 formed at the top ends thereof. A seat 44 is formed between the front and rear frame members for supporting an occupant. Suitable leg supports 46 and 48 are connected to the front frame members 18 and 20, respectively, for supporting the legs of the occupant of the wheelchair 12.

As shown in FIGS. 1 and 2, a ramp attachment 10 is attachable to the wheelchair 12. The ramp attachment 10 includes means, denoted in general by reference number 60, for guiding a bowling ball 50 from the seat area of the wheelchair 12 to the floor and toward the bowling pins. According to the preferred embodiment, the guiding means 60 comprises a pair of spaced first and second rod members 62 and 64, respectively, which are joined together at one end thereof. Preferably, the rod members 62 and 64 are of circular cross section. The rod members 62 and 64 are spaced a predetermined distance apart which is less than the diameter of the bowling ball 50 such that the bowling ball 50 rides downward along the spaced rod members 62 and 64.

As shown in FIG. 1, the guiding means 60 is formed with a first inclined portion 66 having a length sufficient to extend from the seat area of the wheelchair 12 to the floor and a second substantially horizontal portion 68 which is located above the seat 44 of the wheelchair 12. The first portion of the guiding means 60 has a length of approximately 5 to 6 feet such that the first portion 66 extends downward in an inclined manner from the seat area of the wheelchair 12. End caps 70 which are formed of a soft resilient material, such as rubber, are disposed over the ends of the rod members 62 and 64 and rest on the floor.

The second portion 68 of the guiding means 60 has a substantially U-shaped configuration and forms means for supporting the bowling ball 50 above the seat area 44 of the wheelchair 12. In this manner, the bowling ball 50 need only be urged by the occupant from the second portion 68 onto the first portion 66 such that the ball 50 will roll freely down the first portion 66 of the guiding means 60 towards the bowling pins.

A plurality of cross straps 72 interconnect the spaced rod members 62 and 64. The cross straps 72 are connected to the bottom surface of the rod members 62 and 64 and retain the rod members 62 and 64 in the spaced apart configuration. As shown in FIG. 2, each of the rod members 62 and 64 are formed in first and second sections, such as first and second sections 74 and 76 for the rod member 64. One end of the second section 76 is formed with a reduced diameter to engage a corresponding bore in the mating end of the first section 74 to enable the guiding means 60 to be easily disassembled for storage or transport.

The ramp attachment 10 further includes means for slidingly securing the guiding means 60 to the wheelchair 12 such that the guiding means 60 may be slidingly moved laterally across the front of the wheelchair 12 to any desired position. The securing means includes a cross bar 80 which extends laterally across the front of the wheelchair 12. The cross bar 80 is in the form of a tubular member having end caps 82 removably disposed over the ends thereof.

Figures 2, 3:
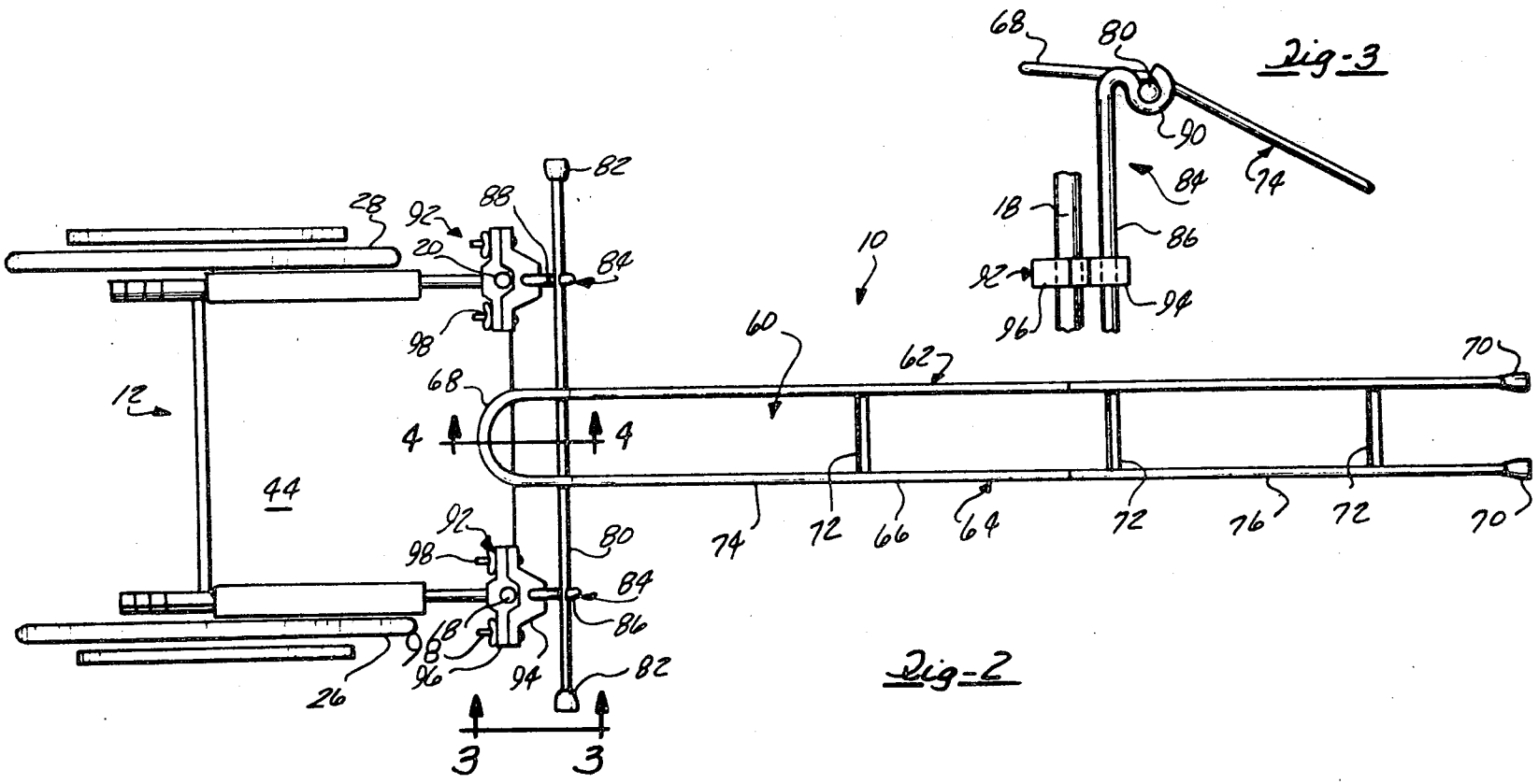
FIG. 3 is a side view generally taken in the direction of arrows 3—3 in FIG. 2.

The securing means further includes first attaching means 84 for attaching the cross bar 80 to the wheelchair 12. The first attaching means 84 also includes a pair of spaced, vertically extending support posts 86 and 88. The support posts 86 and 88 are formed of rod-like members in which the top end 90 is bent over in a hook-like C-shaped configuration, as shown in FIG. 3. The top end portion 90 forms an aperture whose diameter is slightly greater than the diameter of the cross bar 80 such that the cross bar 80 can be inserted therein and supported in position above the seat 44 of the wheelchair 12 and, at the same time, be slidingly movable aterally across the front of the wheelchair 12.

The securing means also includes second attaching means 92 for attaching the support posts 86 and 88 of the first attaching means to the front vertical frame members 18 and 20 of the wheelchair 12. The second attaching means 92 comprises a clamp in the form of two substantially U-shaped straps 94 and 96, each having outward extending end flanges. The straps 94 and 96 are disposed around each of the vertical front frame members, such as frame member 18, shown in FIG. 3. Suitable fasteners 98, such as wing nuts, shown in FIG. 2, extend through apertures in the flanges of the straps 94 and 96 to hold the straps 94 and 96 together in secure engagement around the vertical frame members 18 and 20, respectively, of the wheelchair 12. Each strap 94 and 96 carries one of the support posts 86 and 88, respectively, as shown in FIG. 3, which is fixedly journalled or otherwise mounted thereto. In this manner, the height of the support posts 86 and 88 and thereby the height of the cross bar 80 and the guiding means 60 may be varied with respect to the seat 44 of the wheelchair 12 simply by moving the second attaching means 92 up or down along the vertical frame members 18 and 20.

Figure 4:
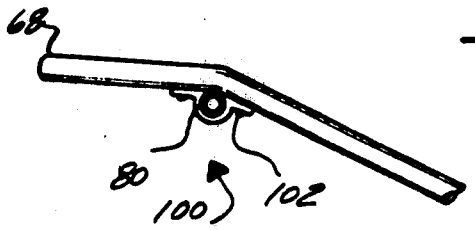
FIG. 4 is a cross-sectional view generally taken along line 4—4 in FIG. 2.

Referring now to FIG. 4, there is shown means 100 for slidingly attaching the guiding means 60 to the cross bar 80. The attaching means 100 comprises a pair of U-shaped straps 102 having outward extending end flanges. The straps 102 are mounted to the bottom surface of the rod members 62 and 64 by suitable fasteners or by welding and are positioned proximate the transition between the first and second portions 66 and 68 of the guiding means 60. The straps 102 form co-axial apertures through which the cross bar 80 is slidingly received and carried. The diameter of the apertures formed by the straps 102 is slightly greater than the diameter of the cross bar 80 such that the cross bar 80 may be slidingly moved through the apertures laterally across the front of the wheelchair 12 to any desired position.

In order to assemble and attach the ramp assembly 10 to the wheelchair 12, the support posts 86 and 88 are first clamped by the second attaching means 92 to the front vertical frame members 18 and 20 of the wheelchair 12 at the desired height. The cross bar 80 is then inserted through the apertures in the top portion 90 of the posts 86 and 88 and the straps 102 on the guiding means 60. The end caps are then disposed over the ends of the cross bar 80. The second portion 68 of the guiding means 60 is thusly positioned over the seat area and lap of the occupant of the wheelchair 12. The bowling ball 50 may be placed on the second portion 68 of the guiding means 60 such that the occupant of the wheelchair 12 need only urge the ball 50 down the inclined portion 66 of the guiding means 60 toward the pins. As the guiding means 60 is movable across the front of the wheelchair 12 and the cross bar 80 is similarly movable laterally across the front of the wheelchair 12, the ramp assembly 10 of the present invention may be positioned as desired in order to direct the bowling ball 50 towards various pins on the bowling alley.

Although the bowling ramp attachment of the present invention has been illustrated and described in conjunction with a wheelchair, it will be understood that it is equally suited for use as a bowling assistance device with a wide variety of other types of ambulatory assistance devices for non or partially ambulatory people. In particular, the bowling ramp attachment of the present invention can be attached to a conventional walker for those having limited ambulatory abilities. In this application, the clamp means are secured to the front vertical supports of the walker such that the top end of the guiding means is located approximate the arms of the user of the walker in order to enable the user to easily push the bowling ball down the guiding means towards the bowling pins.

Figure 5:
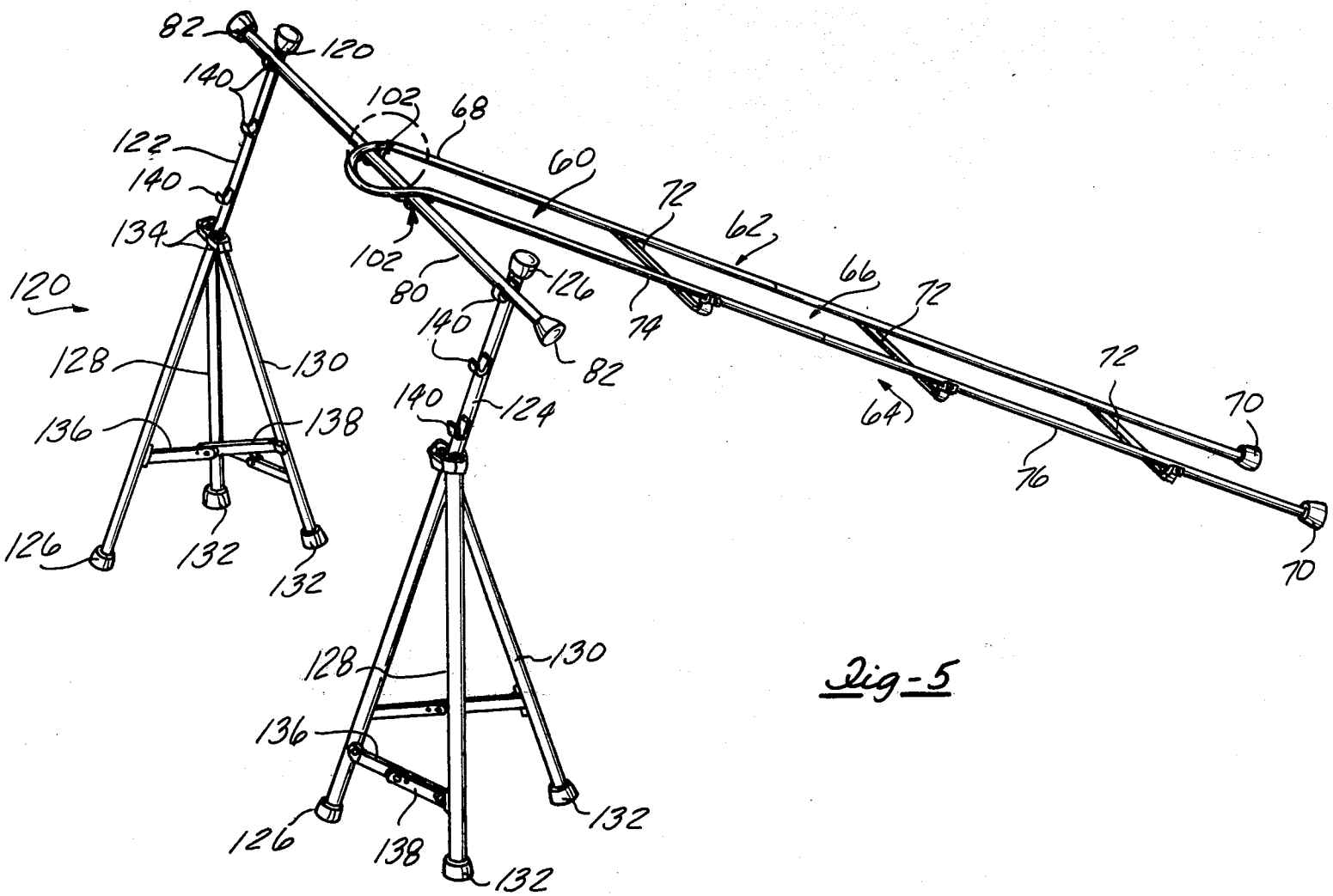
FIG. 5 is a perspective view of another embodiment of the ramp of the present invention.

Referring now to FIG. 5, there is illustrated another embodiment of the ramp of the present invention which is configured for free standing use with a wheelchair or other ambulatory assistance device. In this embodiment, the ramp 120 includes first and second horizontally spaced support posts 122 and 124, respectively. The first and second support posts 122 and 124 preferably comprise elongated rod-like members having a circular cross section. End caps 126, preferably formed of a resilient material, such as rubber, are disposed on each end of the first and second support posts 122 and 124. In use, the support posts 122 and 124 are adapted to rest on the floor at one end and to extend in a substantially upward direction therefrom.

Means are provided for supporting the first and second support posts 122 and 124 in an upright position. Preferably, the supporting means comprises a plurality of leg members, such as leg members 128 and 130, which are connected at one end to an intermediate portion of each support post 122 and 124 and extend downward and outwardly therefrom to engage the floor at the second opposed end. An end cap 132 is disposed at the second end of each leg member 12S and 130.

Preferably, a pair of leg members 128 and 130 are associated with each support post 122 and 124 and cooperate with the lower portion of each support post 122 and 124 to form a tripod for supporting the support posts 122 and 124 in a substantially upright orientation.

In addition, for ease of storage and transportation, the leg members 128 and 130 are adapted to be pivotally connected to the support posts 122 and 124 so as to be extendable and retractable therefrom. A pair of substantially U-shaped brackets 134 are affixed to an intermediate portion of each support post 122 and 124 and pivotally receive one end of each leg member 128 and 130. A pin extends through the spaced legs of the bracket 134 and the leg 128 or 130 to pivotally connect the leg 128 or 130 to the bracket 134.

A pair of straps 136 and 138, which are hingedly connected together at an inner end, are pivotally connected at another end to one of the leg members 128 or 130 and to a lower portion of a support post 122 and 124. The straps 136 and 138 function to maintain the lower portion of each leg member 128 and 130 in an outwardly spaced apart position with respect to the support posts 122 and 124 to form the tripod support.

The ramp 120 also includes an elongated cross bar which is identical to the cross bar 80 described above. As previously indicated, the cross bar 80 includes a pair of removable end caps 82 formed of a resilient material. The cross bar 80 is adapted to extend laterally across the upper ends of the first and second support posts 122 and 124.

As with previous embodiments of the present invention, the ramp 120 includes means 60 for guiding a ball from the cross bar 80 to the floor and means for slidingly attaching the guiding means 60 to the cross bar 80 such that the guiding means 60 is movable laterally across the cross bar 80.

As the construction of the guiding means 60, cross bar 80 and the means for attaching the guiding means 60 to the cross bar 80 are identical to that described above and depicted in FIGS. 1–4, only a brief summary of the construction of the guiding means 60 and the cross bar 80 will be provided herein.

Briefly, the guiding means 60 is formed with a pair of spaced first and second rod members 62 and 64 which are integrally joined together at one end. Preferably, the rod members 62 and 64 are formed in separable sections 74 and 76. A plurality of spaced cross straps 72 extend between the rod members 62 and 64 for maintaining the rod members 62 and 64 at a predetermined spacing apart. Further, the guiding means 60 is formed with an inclined portion 66 and a substantially horizontal upper portion 68.

A pair of U-shaped straps 102 are carried by the guiding means 60 and are co-axially aligned for slidingly receiving the cross bar 80 therethrough so as to slidingly attach the guiding means 60 on the cross bar for lateral movement thereacross.

According to another feature of this embodiment, the ramp 120 includes means for vertically adjusting the height of the cross bar 80 with respect to the floor. The vertical adjusting means includes a plurality of vertically spaced receiving members 140 which are secured to the support posts 122 and 124 and are aligned in vertically spaced pairs for selectively receiving and supporting the cross bar 80 in a horizontal orientation between the first and second support posts 122 and 124.

The receiving members 140 preferably comprise a U-shaped strap member having an open end, one side of which is secured to one of the support posts 122 and 124. The open end of the receiving members 140 is oriented in an upward direction for receiving and supporting the cross bar 80 therein.

As depicted in FIG. 5, three pairs of aligned receiving members 140 are secured to the support posts 122 and 124 to provide three vertical positions for the cross bar 80. It will be understood, however, that any number of aligned pairs of receiving members 140 may be utilized so as to vary the vertical position of the cross bar 80 and the upper end of the guiding means 60 attached thereto as desired.

The cross bar 80 is also adapted to be slidingly received and supported on the support posts 122 and 124 for lateral movement therebetween. The attaching means for cross bar 80 preferably comprises the U-shaped receiving members 140 having a sufficient diameter opening so as to slidingly receive the cross bar 80 therebetween. In this manner, the cross bar 80 may itself be moved laterally between the support posts 122 and 124 and the guiding means 60 may be moved laterally across the cross bar 80 so as to direct the ball down the guiding means 60 in any desired path.

The ramp 120 is ideally suited for use by persons requiring a wheelchair or other ambulatory assistance device. The ramp 120 may be configured so as to vary the space between the support posts 122 and 124 as well as the height of the cross bar 80 with respect to the floor so as to enable persons seated in different sized wheelchairs or other ambulatory assistance devices as well as different sized persons themselves to approach the ramp 120 and urge a ball seated at the upper end of the guiding means 60 down the guiding means 60.

Thus, there has been disclosed a unique bowling assistance device in the form of a ramp attachment for an ambulatory assistance device, such as a wheelchair or walker, which enables the occupant or user to participate in the game of bowling. The ramp attachment of the present invention is constructed of relatively few, lightweight components which enables it to be quickly attached to the ambulatory assistance device. Further, the ramp attachment is constructed so as to be slidingly movable laterally and vertically across the front of the wheelchair or walker which enables it to be easily positioned so as to direct the ball in a variety of paths down the bowling alley. In this way, a non or partially ambulatory person can effectively participate in the game of bowling.

What is claimed is:

1. A bowling ramp comprising:

first and second spaced, upwardly extending support posts adapted to rest on the floor at one end;

a cross bar extending laterally across the first and second support posts;

means for adjusting the vertical height of the cross bar with respect to the floor;

means for slidingly attaching the cross bar to the first and second support posts;

means for guiding a ball from the cross bar to the floor; and means for slidingly attaching the guiding means to the cross bar such that the guiding means is movable laterally across the cross bar.

2. The bowling ramp of claim 1 further including:

means for supporting the first and second support posts in an upright manner on the floor.

3. The bowling ramp of claim 1 wherein the means for slidingly attaching the cross bar to the first and second support posts comprise first and second receiving members secured to the first and second support posts, respectively, the first and second receiving members being co-axially aligned for slidingly receiving the cross bar therethrough.

4. The bowling ramp of claim 3 wherein the receiving members comprise substantially U-shaped members having open ends for removably and slidingly receiving the cross bar therethrough.

5. The bowling ramp of claim 1 wherein the guiding means comprises:

first and second spaced, cylindrical rod members integrally joined together at one end;

the first and second rod members being spaced apart a predetermined distance less than the diameter of the ball such that the ball rolls along the first and second members.

6. The bowling ramp of claim 5 wherein the first and second rod members each include first and second separable sections.

7. The bowling ramp of claim 5 further including:

a plurality of brace members extending between and joined to the first and second rod members to maintain the first and second rod members at a predetermined distance apart.

8. The bowling ramp of claim 1 wherein the guiding means is formed with a first inclined portion and a second, integral, substantially horizontal portion adapted to support the ball thereon.

9. The bowling ramp of claim 1 wherein the attaching means comprises:

a pair of substantially U-shaped straps carried by the guiding means, the straps defining co-axially spaced apertures adapted to slidingly receive the cross bar such that the guiding means is slidingly movable laterally across the cross bar.

10. A bowling ramp comprising:

first and second spaced, upwardly extending support posts adapted to rest on the floor at one end;

means for supporting the first and second support posts in an upright manner on the floor, the supporting means including a plurality of leg members connected at one end to an intermediate portion of each of the first and second support posts and extending downwards and outward therefrom and engaging the floor at a second end spaced from the first and second support posts;

a cross bar extending laterally across the first and second support posts;

means for adjusting the vertical height of the cross bar with respect to the floor;

means for guiding a ball from the cross bar to the floor; and means for slidingly attaching the guiding means to the cross bar such that the guiding means is movable laterally across the cross bar.

11. The bowling ramp of claim 10 wherein the leg members are pivotally connected to the first and second support posts at the one end so as to be extendable away from and retractable towards the first and second support posts.

12. A bowling ramp comprising:

first and second spaced, upwardly extending support posts adapted to rest on the floor at one end;

a cross bar extending laterally across the first and second support posts;

means for adjusting the vertical height of the cross bar with respect to the floor; the adjusting means including a plurality of vertically spaced receiving members secured to the first and second support posts for selectively receiving and supporting the cross bar therebetween in a substantially horizontal position at one of a plurality of predetermined heights with respect to the floor;

means for guiding a ball from the cross bar to the floor; and means for slidingly attaching the guiding means to the cross bar such that the guiding means is movable laterally across the cross bar.

13. A bowling ramp comprising:

first and second spaced support posts;

means for supporting the first and second support posts in an upright manner on the floor;

a cross bar extending laterally across the first and second support posts;

means for slidingly attaching the cross bar to the first and second support posts;

means for adjusting the vertical height of the cross bar with respect to the floor;

means for guiding a ball from the cross bar to the floor; and means for slidingly attaching the guiding means to the cross bar such that the guiding means is movable laterally across the cross bar.

* * * * *